US006808135B1

(12) United States Patent
Landry

(10) Patent No.: US 6,808,135 B1
(45) Date of Patent: Oct. 26, 2004

(54) FLUID-FILLED WEIGHT, PARTICULARLY SUITED FOR USE IN IRRIGATION SYSTEMS

(75) Inventor: Frank Landry, Farwell, TX (US)

(73) Assignee: L & L Pallet Supply, Inc., Farwell, TX (US)

( * ) Notice: Subject to any disclaimer, the term of this patent is extended or adjusted under 35 U.S.C. 154(b) by 66 days.

(21) Appl. No.: 10/446,812

(22) Filed: May 29, 2003

(51) Int. Cl.[7] ..... B05B 3/00
(52) U.S. Cl. ..... 239/723; 222/464.4
(58) Field of Search ..... 239/302, 315, 239/340, 542, 722, 723, 724, 725, 726, 727, 728, 729, 730, 731, 732, 733, 734, 735, 736, 737, 738, 739, 740, 741, 742; 222/464.4

(56) References Cited

U.S. PATENT DOCUMENTS 3,261,371 A * 7/1966 Vernon ..... 134/168 R
4,138,095 A 2/1979 Humphrey
5,310,116 A 5/1994 Broyhill
6,264,073 B1 7/2001 Good et al.
6,382,525 B1 5/2002 Santiesteban et al.

* cited by examiner

*Primary Examiner*—Henry Bennett
*Assistant Examiner*—Malik N. Drake
(74) *Attorney, Agent, or Firm*—Shlesinger, Arkwright & Garvey LLP

(57) ABSTRACT

Weight, particularly suited for use in irrigation systems, includes a body having a chamber with inner and outer walls. The chamber is sized and configured for receiving a fluid such as water, storing the water in use, and adding to the weight of the overall device. The unfilled weight is lightweight when empty for shipment, and relatively heavy, in use. A portion of water coming into the weight is diverted, such as when irrigating a field and the weight is connected to an irrigation line. Such diverted water fills the chamber and increases the service weight. The weight may include an outlet configured for attaching to an irrigation sprayer head. When the flow of irrigation water is stopped, the weight retains some water, maintains the desired service weight, and prevents undesired movement of the weight and associated sprinkler head.

20 Claims, 2 Drawing Sheets

FLUID-FILLED WEIGHT, PARTICULARLY SUITED FOR USE IN IRRIGATION SYSTEMS

FIELD OF THE INVENTION

The invention relates to weights. More particularly, the invention relates to fluid-filled weights, and even more particularly, to fluid-filled weights suited for maintaining the correct orientation of an element attached to the weight such as a sprayer or sprinkler in an irrigation system, and a method of using such.

BACKGROUND OF THE INVENTION

Weights, including metal weights for weighting down sprinkler heads used in irrigation systems are known. Known prior art devices include the following United States patents:

U.S. Pat. No. 6,382,525 B1 to Santiesteban et al.

U.S. Pat. No. 6,264,073 B1 to Good et al.

U.S. Pat. No. 5,310,116 to Broyhill

U.S. Pat. No. 4,138,095 to Humphrey

Known weights have all been found to be unsuitable, and to have many drawbacks, particularly weights for use in irrigation systems.

OBJECTS AND SUMMARY OF THE INVENTION

It is an object of the invention to provide a weight which overcomes the drawbacks of the prior art devices.

Another object of the invention is to provide a weight which is easier to use than prior art devices.

A further object of the invention is to provide a weight which is lightweight for achieving savings in manufacturing and shipping costs, yet which is suitable for its intended purpose.

Another object of the invention is to provide a weight that does not rust in use.

Yet another object of the invention is to provide a weight, such as a fluid-filled weight, which automatically assumes its desired weight, such as its desired service weight and its desired orientation, in use.

Another object of the invention is to provide a weight which is sufficiently heavy to maintain an object to be weighted, such as an irrigation sprinkler head, in a desired orientation, even under windy conditions, yet which is lightweight for shipping.

A still further object of the invention is to provide a weight which has a high fluid-filled to unfilled weight ratio.

Another object of the invention is to provide a weight for use in irrigation systems which is sufficiently heavy so that it weights down sprinkler heads in a series of adjacent sprinkler heads in an irrigation system, yet without having such a large cross sectional area that wind would tend to blow adjacent weights and associated sprinkler heads into each other and damage the sprinkler head on the end of drop hoses in such sprinkler irrigation systems, for example.

Another object of the invention is to provide a weight which is lightweight for transportation and installation in a sprinkler system, yet which automatically assumes the desired operational weight after installation in the irrigation system when the water has been turned on and the irrigation water automatically fills the weight, and which likewise maintains sufficient water in the water-filled weight so that when the water has been turned off when the irrigation system is not irrigating, the weights do not blow around sufficiently in the wind so as to strike adjacent weights and become damaged, or so as to allow associated sprinkler heads to become damaged.

A still further object of the invention is to provide a lightweight weight which is easy to manufacture, environmentally friendly, has a long service life, is easily put in place, such as being readily attached to irrigation lines, when in use in irrigation systems, which can be used outdoors, and which has a long useful life even when used continuously outdoors.

In summary, the weight according to the invention may include a body having inner and outer walls that define a chamber for being filled with a fluid, such as water. An inlet into the chamber is configured for being connected to a fluid supply, and for directing a portion of a liquid, such as water, into the chamber, in use. In that manner, the fluid chamber fills to a desired amount, in use, and achieves the desired useful weight. A further portion of the water which is not directed into the chamber is exited to an outlet which may be connected to a sprinkler head, for example, when used in irrigation systems. Thanks to the configuration of the weight, the weight can be made of lightweight material, filled automatically after installation in line with a water supply, and even maintains a desired water volume after the water flow has been turned off, to maintain a desired service weight. The weight may also be configured to maintain a desired orientation of a device attached to it, such as a sprinkler head in a irrigation system.

Relative terms such as up, down, left, and right, are for convenience only and are not intended to be limiting.

DETAILED DESCRIPTION OF THE INVENTION

Figure 1:
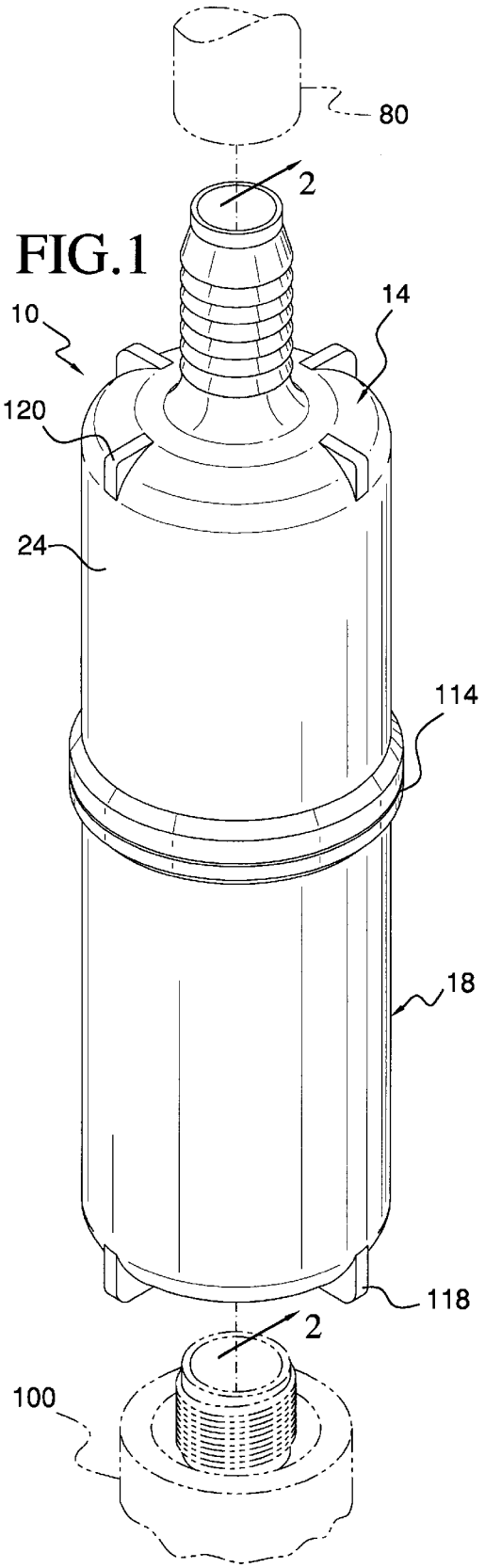
FIG. 1 is a perspective view of an embodiment of a weight according to the invention, in use.
Figure 2:
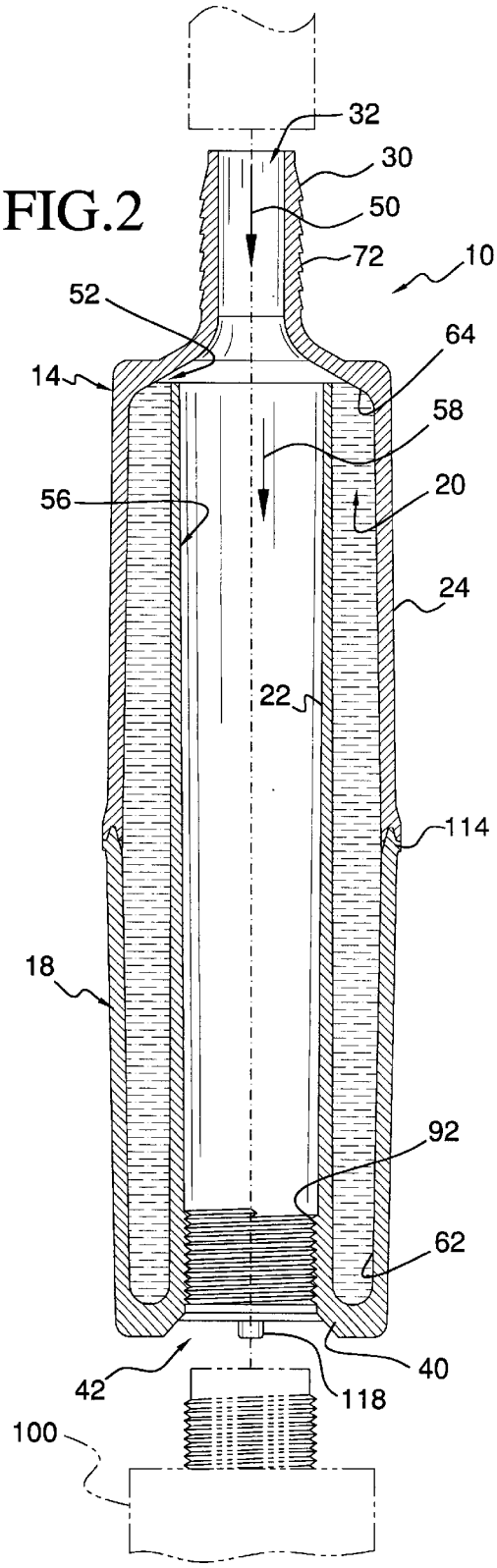
FIG. 2 is a sectional view of the embodiment of the invention of FIG. 1 along lines 2—2 of FIG. 1, in use.
Figure 3:
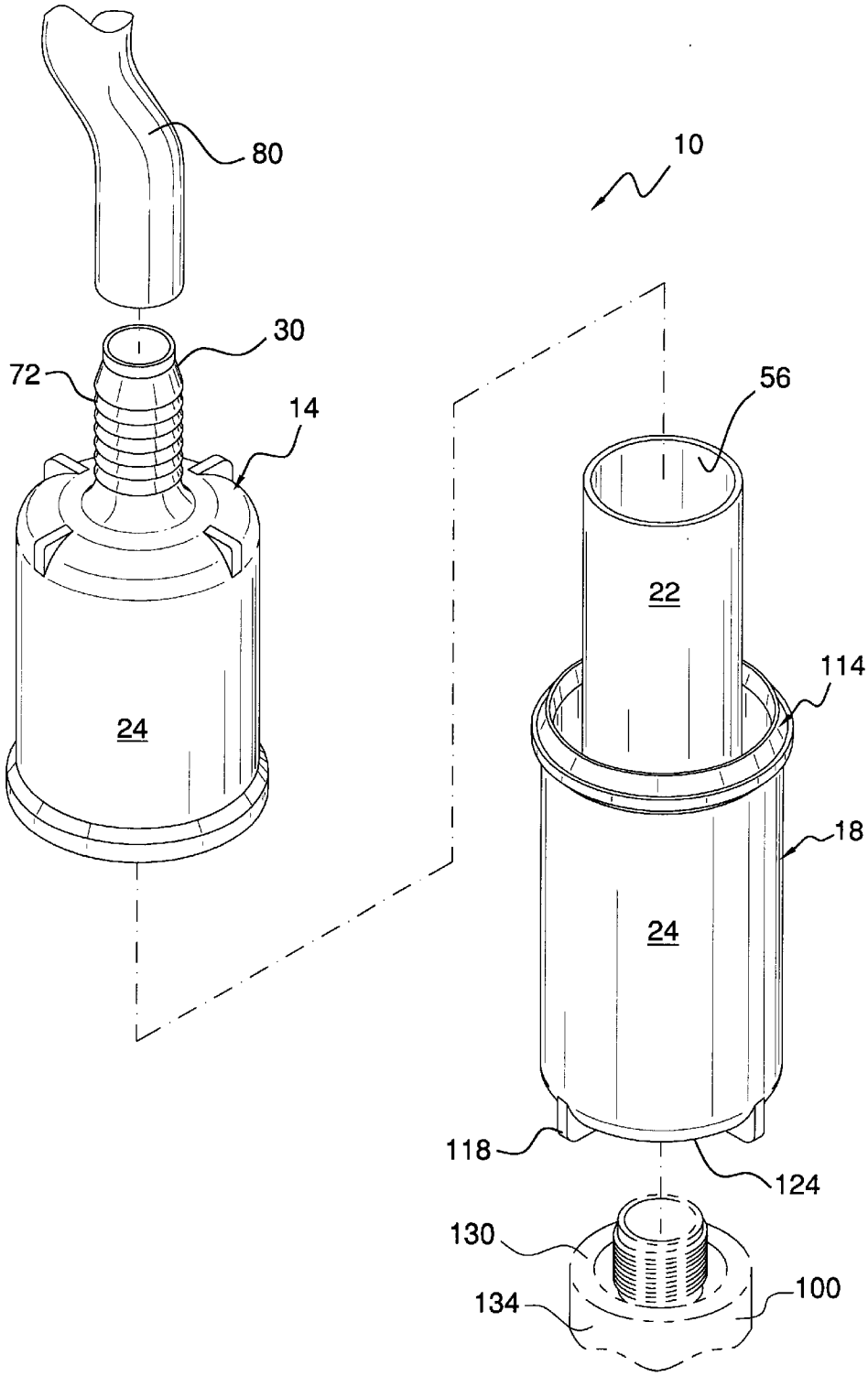
FIG. 3 is an exploded perspective view of the embodiment of FIGS. 1 and 2, in use.

FIGS. 1–3 illustrate an embodiment of a weight 10 according to the invention.

Weight 10 may include an upper portion 14 and a lower portion 18.

A chamber 20 may be defined by an inner wall 22 and an outer wall 24. One or both of inner and outer walls 22, 24 may be integral with the remainder of weight 10.

An inlet 30 may be provided at upper portion 14, and may define a fluid passage 32. Likewise, an outlet 40 may be defined at a lower portion 18 and may include a fluid outlet passage 42.

The inlet 30 may be configured so that a liquid, such as water, which enters passage 32 flows in a direction as indicated by an arrow 50, and then at least a portion of such a liquid is directed into chamber 20, as indicated by a diverting passage 52. A further portion of the liquid, such as water, may be exited to the outlet 40 by a connecting passage 56. Connecting passage 56 directs fluid typically in the direction of arrow 58, in use, as shown.

Diverting passage 52 may be configured so that, in use, substantially regardless of the orientation of weight 10, and specifically regardless of the orientation of chamber 20, at least a portion of the liquid flowing in direction 50 is diverted into diverting passage 52, and begins to fill (or continues to fill) chamber 20.

By the phrase substantially any orientation of weight 10, it would be appreciated that what is meant is substantially any orientation of chamber 20 so that, for example, a lower portion 62 of chamber 20 is lower than an upper portion 64 of chamber 20. The meaning of substantially any orientation may include any orientation which would cause water flowing in direction 50 to be sufficiently diverted into passage 52, and thus into chamber 20, so that more water is added to chamber 20, thanks to water flow and pressure in passage 32 in direction 50 than is lost by any backflow of water flowing opposite to the flow into passage 52, such backflow owing to any pressure exerted by water already present in chamber 20, for example.

One or more engaging elements, such as hose barbs 72, may be provided on inlet 30 to assist in connecting inlet 30 to a hose 80, such as an irrigation line, in use.

In a similar manner, one or more engaging elements, such as threads 92, may be provided on outlet 40 to assist in engaging with a sprinkler head or spray nozzle 100, when in use in irrigation systems, for example.

To further regulate fluid flow through passage 56, the size and configuration of outlet 40 may be varied.

Good results have been achieved when weight 10 has been made of plastic, including upper half mated at a seam 114 with lower portion 18. Seam 114 may be glued or welded to join upper and lower portions 14 and 18 together respectively. Such gluing or welding, in the case of weight 10 being made of plastic or metal, may be carried out by conventional methods of welding plastics and metals.

One or more lower stabilizing elements or feet 118 may be provided at a lower portion of weight 10.

Likewise, one or more extensions or feet 120 may be provided on upper portion 18. A lower face 124 of weight 10 may eliminate or supplement the use of feet 118. In use, feet 118 may engage an upper surface 130 or a side surface 134 of sprinkler head 100, depending on the type of sprinkler head 100 used with weight 10. In that manner, the connection between weight 10 and its associated sprinkler head 100 may be enhanced.

It is likewise contemplated that metals, including aluminum, may be used instead of or in additional to plastic, for example. Such plastics maybe weather-resistant plastics, such as plastics resistant to degradation on exposure to ultra-violet (UV light).

In use, such as in a center-pivot, or linear-move irrigation systems, or other irrigation systems which benefit from using one or more weights, weight 10 may be used in one or more locations.

For example, current irrigation systems include main water lines to which a number of typically smaller, flexible drop lines 80 are attached. Each drop line 80 directs water to an associated spray nozzle or sprinkler head 100. The inventive weight 10 may be placed in line between drop line 80 and spray nozzle 100 as shown in FIGS. 1–3. Thanks to the use of drop line 80, the spray nozzle 100 may be located closer to the crops being irrigated, and spray losses are reduced; i.e., sprayed water losses.

Given that drop lines 80 are typically flexible hoses, wind blowing against lines 80, with or without conventional weights, results in uneven plant growth. The uneven plant growth reduces per acre yields of the irrigated crop. Further, when the wind is sufficiently strong, conventional sprinkler heads 100 hanging from drop lines 80 can be blown into each other and damaged. In use, inventive weight 10 readily achieves its service weight, thanks to water coming through drop line 80 in the direction of arrow 50, and being diverted into passage 52 for filling chamber 20. Undiverted irrigation water traveling in the direction of arrow 58 exits outlet 42 and is distributed and sprayed onto the crops being irrigated by sprinkler head 100.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. A weight, comprising;

a) a body including an inner wall and an outer wall;

b) the inner wall being provided at a distance from the outer wall, the inner and outer walls defining a chamber;

c) an inlet fluidly connected to the chamber, the inlet being configured for being connected to a fluid supply;

d) an outlet fluidly connected to the chamber, the outlet being configured for being connected to a liquid distribution device;

e) the inlet being configured and disposed so that when a liquid enters the inlet, in use, a portion of the liquid enters and at least partially fills the chamber, and a further portion of the liquid which enters the inlet exits to the outlet;

f) the chamber being sized and configured so that the chamber serves as a weight when at least partially filled with the portion of the liquid which enters the chamber, in use;

g) the chamber being configured and disposed so that, in use, when the body is at least partially upright and a liquid flow is stopped, the chamber remains at least partially filled with a liquid, and the at least partially filled chamber functions as a weight and causes the outlet and a liquid distribution device connected to the outlet to remain in a desired orientation; and h) the chamber being configured and disposed so that, in use, when the body is at least partially upright and a liquid flow is maintained, the chamber remains at least partially filled with a liquid, and the at least partially filled chamber functions as a weight and causes the outlet and a liquid distribution device connected to the outlet to remain in a desired orientation.

2. A weight as in claim 1, wherein:

a) the inlet is located in an upper portion of the chamber and the outlet is located in a lower portion of the chamber.

3. A weight as in claim 1, wherein:

a) the inlet is located above the middle of the chamber and the outlet is located below the middle of the chamber.

4. A weight as in claim 1, wherein:

a) the chamber is substantially symmetrical.

5. A weight as in claim 1, wherein:

a) the chamber is substantially cylindrical.

6. A weight as in claim 1, wherein:

a) the body includes a plastic.

7. A weight as in claim 1, wherein:

a) the inlet is configured for being attached to a flexible tube.

8. A weight as in claim 1, wherein:

a) the inlet is configured for being attached to an irrigation hose;

b) the outlet is configured for being attached to an irrigation sprayer; and c) the desired orientation is a substantially downwardly extending orientation so that a liquid sprayed by an irrigation sprayer attached to the outlet is sprayed substantially downwardly.

9. A weight as in claim 1, wherein:

a) the chamber extends substantially around the perimeter of the body.

10. A weight, comprising;

a) an inner wall and an outer wall;

b) the inner wall being spaced apart from the outer wall, and defining a chamber;

c) an inlet fluidly connected to the chamber, the inlet being connectable to a fluid supply;

d) an outlet fluidly connected to the chamber, the outlet being connectable to a liquid distribution device;

e) the inlet being configured so that when a liquid enters the inlet, a portion of the liquid is directed to, enters, and at least, partially fills the chamber, and the rest of the liquid exits to the outlet;

f) the chamber including an upper portion and a lower portion, and being configured so that the chamber serves as a weight when at least partially filled with the portion of the liquid which enters the chamber;

g) the chamber being configured to at least partially fill with a liquid, in use, so that when the upper portion of the chamber is at least as high as the lower portion of the chamber and liquid flow is maintained, in use, the at least partially filled chamber functions as a weight and causes the outlet and a liquid distribution device connected to the outlet to obtain a desired orientation; and h) the chamber being configured to remain at least partially filled with a liquid, in use, so that when the upper portion of the chamber is above the lower portion of the chamber and liquid flow is stopped, in use, the at least partially filled chamber functions as a weight and causes the outlet and a liquid distribution device connected to the outlet to remain in a desired orientation.

11. A weight as in claim 10, wherein:

a) the inlet is located in an upper portion of the chamber and the outlet is located in a lower portion of the chamber.

12. A weight as in claim 10, wherein:

a) the inlet is located above the middle of the chamber and the outlet is located below the middle of the chamber.

13. A weight as in claim 10, wherein:

a) the chamber is substantially symmetrical.

14. A weight as in claim 10, wherein:

a) the chamber is substantially cylindrical.

15. A weight as in claim 10, wherein:

a) the body includes a plastic.

16. A weight as in claim 10, wherein:

a) the inlet is configured for being attached to a flexible tube.

17. A weight as in claim 10, wherein:

a) the inlet is configured for being attached to an irrigation hose;

b) the outlet is configured for being attached to an irrigation sprayer; and c) the desired orientation is a substantially downwardly extending orientation so that a liquid sprayed by an irrigation sprayer attached to the outlet is sprayed substantially downwardly.

18. A weight as in claim 10, wherein:

a) the chamber extends substantially around the perimeter of the body.

19. A weight as in claim 10, wherein:

a) a barb is provided on the inlet, the barb being configured for engaging a hose.

20. A weight as in claim 10, wherein:

a) threads are provided on the outlet.

* * * * *